United States Patent [19]

Wakatsuki

[11] Patent Number: 4,897,516

[45] Date of Patent: Jan. 30, 1990

[54] PUSH BUTTON SWITCH

[75] Inventor: Yoshihiro Wakatsuki, Izumo, Japan

[73] Assignee: Omron Tateisi Electronics Co., Kyoto, Japan

[21] Appl. No.: 251,077

[22] Filed: Sep. 28, 1988

Related U.S. Application Data

[63] Continuation of Ser. No. 891,613, Aug. 1, 1986, abandoned.

[30] Foreign Application Priority Data

Aug. 5, 1985 [JP] Japan ..... 60-119371

[51] Int. Cl.[4] ..... H01H 13/06

[52] U.S. Cl. ..... 200/302.2; 200/314

[58] Field of Search ..... 200/302.2, 302.1, 314, 200/341

[56] References Cited

U.S. PATENT DOCUMENTS

| | | | |
|---|---|---|---|
| 4,420,665 | 12/1983 | Conrad | 200/302.2 |
| 4,451,160 | 5/1984 | Fluck | 200/302.1 |
| 4,540,864 | 9/1985 | Krasser et al. | 200/302.2 |

*Primary Examiner*—Linda J. Sholl

*Attorney, Agent, or Firm*—Stevens, Davis, Miller & Mosher

[57] ABSTRACT

A push button switch comprising a case, an operation section having operation plungers which can be pushed into the case and which can be separated from each other, and a switch section which is made operative and inoperative by the pushing of the operation section housed in the case, characterized by a first rubber seal for sealing between a lower plunger of the operation plungers and the case, and by a second rubber seal for sealing between the operation plungers.

4 Claims, 3 Drawing Sheets

PUSH BUTTON SWITCH

This application is a continuation of application Ser. No. 891,613, filed Aug. 1, 1986 now abandoned.

BACKGROUND OF THE INVENTION

1. Field of the Invention

The present invention relates to a push button switch of the water, oil and dust proof type.

2. Prior Art

The push button switch having such arrangement as shown in FIG. 1, for example, has been well known as the conventional one of the water proof type. This push button switch is also of the illuminant type and its operation plunger system is divided to upper and lower plungers 1 and 2. When the upper plunger 1 is removed from the case 3, the light source can be exchanged.

The reason why water proofness is needed in the case of the push button switch having such arrangement as described above is that water and others must be prevented from entering into the switch section located in the lower portion of the case 3 through between the case 3 and the operation section including the operation plungers and located in the upper portion of the case 3. A clearance is needed between the operation section and the case 3 because the operation section is arranged to come into and out of the case, and when water and others enter into the switch section through the clearance, the switch section is made inoperative. In order to prevent this, the rubber seal 5 is interposed between the lower plunger 2 and the case 3 in the case of the conventional push button switch having the arrangement as shown in FIG. 1. The rubber seal 5 is a ring having a reversed U-shape in section, and its outer circumferential rim is fixed to the case 3 by the fastening ring 6 while its inner circumferential rim to the groove 2*a* on the upper face of the lower plunger 2. When assembly is finished, the inner circumferential rim of the rubber seal 5 is forcedly engaged with the groove 1a on the underside of the upper plunger 1. When the upper plunger 1 is pushed down, the lower plunger 2 is moved against the compression coil spring 7 to render the switch section operative. These movements of the operation plungers 1 and 2 are allowed by the transformation of the rubber seal 5, and sealing between the operation plungers 1, 2 and the case 3 can be guaranteed by the rubber seal 5 in spite of the movements of the operation plungers 1 and 2.

In the case of the conventional push button switch having the above-described arrangement, however, the sealing capacity between the operation plungers 1, 2 and the rubber seal 5 becomes insufficient to lower the water proofness when the upper plunger 1 is attached slant to or insufficiently forced into the lower plunger 2. Sufficient sealing capacity can be achieved when the inner circumferential rim of the rubber seal 5 is fixed to the outer circumference of the upper plunger 1, but when it is arranged like this, the upper plunger 1 cannot be detached from the case 3.

SUMMARY OF THE INVENTION

The present invention is therefore intended to eliminate the above-mentioned drawbacks.

An object of the present invention is to provide a pushbutton switch wherein upper and lower plungers can be separated from each other and sufficient sealing capacity can be provided.

Another object of the present invention is to provide a push button switch simple in construction and capable of providing efficient sealing capacity.

In order to achieve these objects, a push button switch of the present invention is provided with a first rubber seal for sealing between the lower one of separable operation plungers and a case and also with a second rubber seal for sealing between the operation plungers.

When the push button switch has the above-described arrangement, sealing can be established between the lower operation plunger and the case and also between the operation plungers to thereby allow the push button switch to have more reliable water, oil and dust proofness.

The present invention will be described in detail referring to the accompanying drawings.

DETAILED DESCRIPTION OF THE PREFERRED EMBODIMENT

Figure 1:
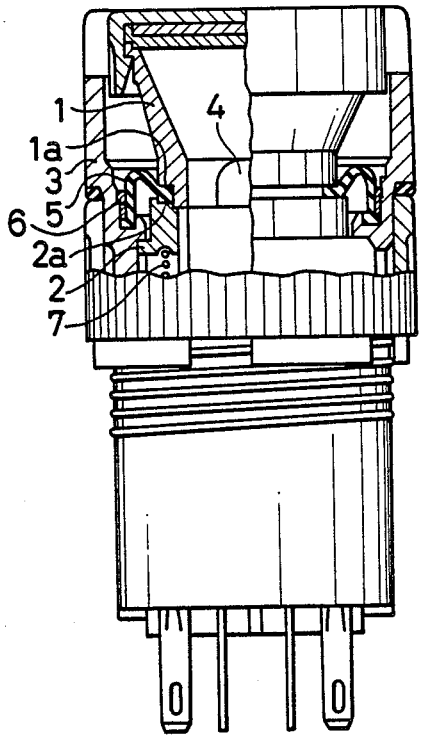
FIG. 1 Prior Art
FIG. 1 is a partly-sectioned front view showing the conventional push button switch.
Figure 2:
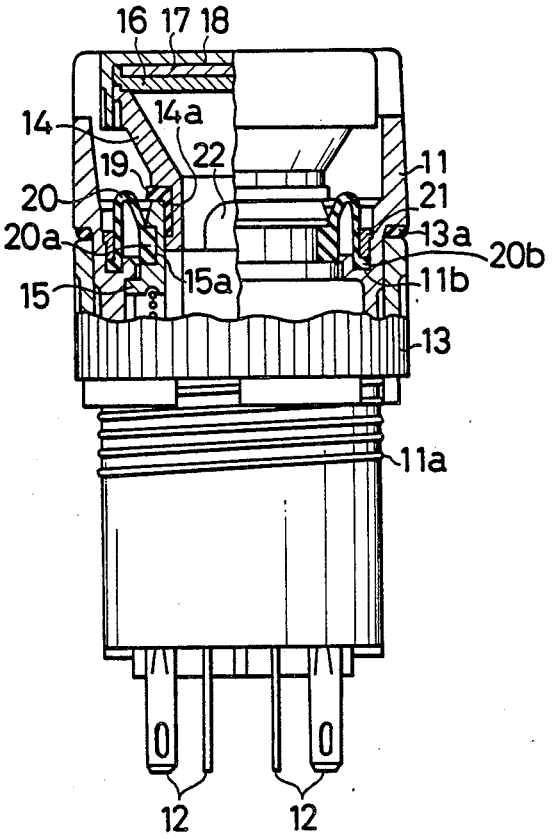
FIG. 2 is a partly-sectioned front view showing an example of the push button switch according to the present invention.
Figure 3:
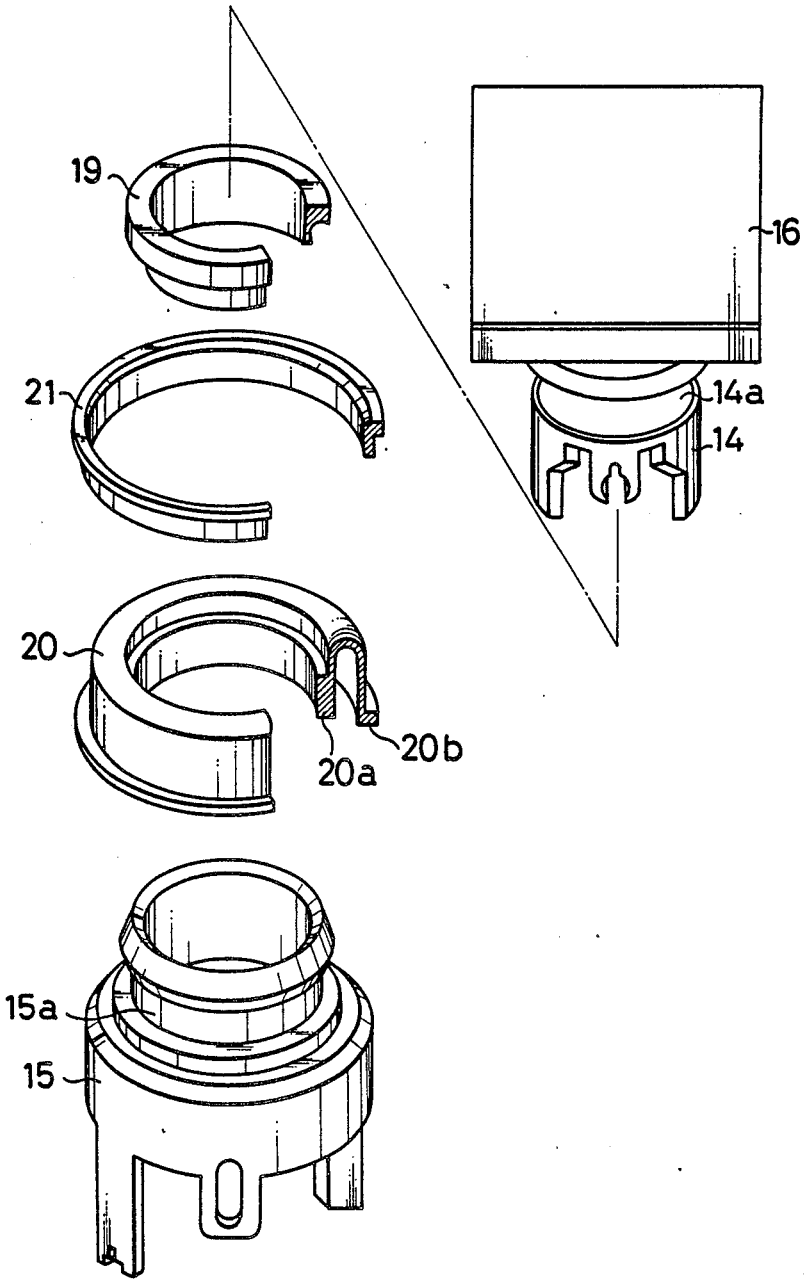
FIG. 3 is a perspective view showing an arrangement of the sealing section dismantled in the case of the push button switch shown in FIG. 2.

FIGS. 2 and 3 show an example of the push button switch according to the present invention. This push button switch is almost same in construction as the conventional one shown in FIG. 1 except its seal arrangement and it comprises a case 11 provided with terminals 12 at the bottom thereof, operation plungers and a switch section housed in the case 11.

The case 11 has a square cross-section at the uper portion thereof and as a cylinder at the lower portion thereof. An operation section including an operation plunger system is located in the upper portion of the case 11 and a switch section which is made operative and inoperative by the operation plunger system is located in the lower portion thereof. The switch section is not limited in its construction by the present invention and it is not shown accordingly, but it is connected outside through the terminals 12 at the bottom of the case 11. A thread 11a is formed on the outer circumference of the case 11 and an attachment ring 13 is screwed onto the thread 11a. The lower portion of the case 11 is inserted into a hole in the panel and the attachment ring 13 is screwed onto the thread 11a, thereby allowing the switch to be attached to the panel. Numeral 13*a* represents a packing.

The operation plunger system is divided into upper and lower plungers 14 and 15, and the upper plunger 14 can be detached from the lower plunger 15 fixed in the case 11. The upper plunger 14 is like a funnel rectangular at the upper portion and circular at the lower portion. The inner face of the upper portin of the upper plunger 14 is a reflector and a diffusion plate 16 is welded to the upper opening of the upper plunger 14 according to the ultrasonic welding. A carved plate 17 is mounted on the diffusion plate 16 and a cap 18 is further fitted onto the upper outer circumference of the plunger 14.

A ring-shaped groove 14*a* is formed round the lower outer circumference of the upper plunger 14 and a rubber seal 19 which is of reversed L in section and which serves as a second seal member is fitted into the groove 14*a*. The inner diameter of the second rubber seal 19 is made a little smaller than the outer diameter of the groove 14*a* and the second rubber seal 19 is forcedly fitted into the groove 14*a*. A ring-shaped groove 15*a* is formed round the upper outer circumference of the lower plunger 15 and an inner circumferential rim 20*a* of a rubber seal 20 which is a ring having a reversed U shape in section and which serves as a first seal member is fitted into the groove 15*a*. The inner diameter of the inner circumferential rim 20*a* is made a little smaller than the outer diameter of the groove 15*a* and the inner circumferential rim 20*a* is forcedly fitted into the groove 15*a*. An outer circumferential rim 20*b* of the first rubber seal 20 is fitted into a ring-shaped groove 11*b* on the case 11 and then fixed thereto by a fastening ring 21. The outer circumferential rim 20*b* of the first rubber seal 20 may be welded to the case 11 according to the ultrasonic welding.

FIG. 3 is a perspective view showing members for use to this seal dismantled.

The first rubber seal 20 is fitted into the grooves 11*b* and 15*a* to provide reliable sealing between the case 11 and the loewr plunger 15, while the second rubber seal 19 is fitted into the groove 14*a* on the upper plunger 14 to provide reliable sealing between the lower plunger 15 and the upper plunger 14. Sufficient sealing is needed particularly between the lower plunger 15 and the upper plunger 14 because the upper plunger 14 is arranged detachable from the lower plunger 15. In the case of this embodiment, the second rubber seal 19 is of reversed L in section, providing a sealing in the radius direction (or sealing between the inner circumference of the lower plunger 15 and the outer circumference of the upper plunger 14) and another sealing in the axial direction (or sealing between the upper face of the lower plunger 15 and the lower face of the upper plunger 14), so that more reliable sealing can be guaranteed between the lower plunger 15 and the upper plunger 14.

When a light source 22 in the case 11 is broken, both sides of the cap 18 is grasped and lifted. The upper plunger 14 with the second rubber seal 19 attached thus comes out of the lower plunger 15 together with the cap 18, thereby enabling the light source 22 to be exchanged with a new one. The upper plunger 14 is then forced into the lower plunger 15 to become combined with each other through the second rubber seal 19.

Although the present inention has been described with reference to the preferred embodiment thereof, it should be understood that the present invention is not limited to the embodiment but that various changes and modifications can be made without departing from the scope and spirit of the present invention.

I claim:

1. A push button switch comprising a case, an operation section have an operation plunger system including upper and lower plungers, said upper and lower plungers being engaged together by an engagement which permits manual separation of said upper plunger from said lower plunger by a pulling force applied to said upper plunger, said plungers being able to be pushed into the case, said case comprising an inner surface for guiding said lower plunger, and a switch section which is made operative and inoperative by the pushing of an operation section thereof housed in the case by said lower plunger, a first seal member arranged between the lower plunger and the case, a second seal member arranged between the upper plunger and the lower plunger, said upper plunger including a lower portion having a first ring-shaped groove around an outer circumference of said lower portion, said lower plunger including an upper outer circumferential portion with a second ring-shaped groove, said second seal member being disposed within said first ring-shaped groove, and said first seal member being elongated and having on one end thereof an inner circumferential rim fitted into said second ring-shaped groove, said one end of said first seal member being movable with said lower plunger when said lower plunger is pushed to move relative to said case, said second seal member being detachable from said lower plunger with said upper plunger and remaining attached to said upper plunger by engagement with said first ring-shaped groove when said upper plunger is detached from said lower plunger.

2. A push button switch according to claim 1 wherein the first and second seal members are rubber.

3. A push button switch according to claim 1 wherein the second seal member has an almost reversed L-shape in section and provides a sealing in the radius direction and another sealing in the axial direction between the upper plunger and the lower plunger.

4. A push button switch according to claim 1, wherein said case includes a third ring-shaped groove, said first seal has on its other end an outer circumferential rim fitted into said third ring-shaped groove, and said switch further comprises a fastening ring disposed to hold the outer circumferential rim of the first seal member within the third ring-shaped groove.

* * * * *